US005390399A

United States Patent [19]

Dilo

[11] Patent Number: 5,390,399

[45] Date of Patent: Feb. 21, 1995

[54] APPARATUS FOR TACKING A YARN TO A NEEDLED FLEECE

[75] Inventor: Johann P. Dilo, Eberbach, Germany

[73] Assignee: Oskar Dilo Maschinenfabrik AK, Eberbach, Germany

[21] Appl. No.: 925,557

[22] Filed: Aug. 4, 1992

[30] Foreign Application Priority Data

Sep. 5, 1991 [DE] Germany ..... 4129560

[51] Int. Cl.[6] ..... B32B 5/06

[52] U.S. Cl. ..... 28/109; 28/107; 28/115

[58] Field of Search ..... 112/80.01, 80.3, 80.73, 112/80.7; 28/107, 108, 109, 111, 113, 114, 115, 159, 160, 163

[56] References Cited

U.S. PATENT DOCUMENTS

| | | | |
|---|---|---|---|
| 3,538,564 | 11/1970 | Skoler et al. | 28/107 X |
| 3,681,823 | 8/1972 | Dilo | 28/107 |
| 4,047,269 | 9/1977 | Lochner | 28/111 |
| 4,876,973 | 10/1989 | Marrache et al. | 28/104 |
| 4,977,653 | 12/1990 | Pum | 28/111 |
| 5,018,255 | 5/1991 | Bolliand | 28/107 |
| 5,042,405 | 8/1991 | Bradley et al. | 112/80.01 |
| 5,129,131 | 7/1992 | Kimura et al. | 28/107 |

FOREIGN PATENT DOCUMENTS

| | | | |
|---|---|---|---|
| 0059292 | 9/1982 | European Pat. Off. . | |
| 0183952 | 6/1986 | European Pat. Off. . | |
| 411647 | 3/1989 | European Pat. Off. | 28/107 |
| 0411647A1 | 8/1990 | European Pat. Off. . | |
| 2084463 | 12/1971 | France . | |
| 2010350A | 6/1979 | United Kingdom . | |
| 262455 | 11/1988 | U.S.S.R. | 28/108 |

*Primary Examiner*—Clifford D. Crowder
*Assistant Examiner*—Larry O. Worrell, Jr.
*Attorney, Agent, or Firm*—Rosen, Dainow & Jacobs

[57] ABSTRACT

Apparatus for tacking a yarn in a predetermined pattern onto a needled fleece, which lies on a support consisting of brushes and which is supported by the free ends of the brush bristles comprising a pressure plate unit which is movable parallely to the support and having a yarn channel extending basically vertically therethrough, yarn supply structure for supplying the yarn along a yarn path from a yarn supply into the yarn channel, a needle having laterally protruberant projections, which are suitable for piercing yarn fibers into the needled fleece, a needle support connected to the pressure plate unit and mounting the needle, and drive structure for moving up and down the needle support in a direction towards and from the pressure plate unit. The device is suitably combined with a needle loom, which pierces the fibers of the yarn tacked to the needled fleece by the device through the needled fleece. (FIG. 1)

29 Claims, 3 Drawing Sheets

16
17
2
18
3
5
6
4
7
10
9
11
8
1
17
20
12
13
15
21
23
14
19
13
12
22

APPARATUS FOR TACKING A YARN TO A NEEDLED FLEECE

FIELD OF THE INVENTION

The invention relates to an apparatus for tacking at least one yarn in a predetermined pattern onto a needled textile fleece, which is located on a support consisting of brushes and which is supported by the free ends of the bristles of said brushes.

BACKGROUND OF THE INVENTION

From EP 0 411 647 A1 it is known to provide a pattern of fibers of different colors in a needled fiber fleece by applying thereto a second fibrous fleece, which consists of fibers of different colors, onto the entire surface of said first or carrier fleece in stripes or in form of punched out elements and by supplying this laminate to a needle loom, the needle beams of which carry velour needles, especially crown needles or fork needles. By means of this needle loom, the fibers of the fleece of the different color are needled through the underlying carrier fleece in the pattern formed by the pattern of said fibers or by the arrangement of needles at the needle beams, said carrier fleece being supported by a brush band, into which the needles can pierce in. If the different color fleece is applied onto the carrier fleece as a continuous fleece, patterns repeating in register rounds can be generated, if the support is lowered and raised in periods and if the laminate is transported through the needle loom in lengths corresponding to the register rounds with the support being lowered.

In the cited publication, as an alternative is mentioned to supply the different color pattern forming fibers not as a fleece but as individual fibers by the aid of a continuous or discontinuous air stream and to put them on a needled carrier fleece by means of a mouth piece. In order to form patterns, the mouth piece is guided parallely to the surface of the carrier fleece. In order to avoid the applied fibers to resolve from the carrier fleece, a vacuum is effective on the reverse side of the carrier fleece. This technique is relatively expensive and requires to immediately feed the needled carrier fleece supplied with the different color fibers to the needle loom.

Another alternative, which is described in the aforementioned publication suggests, to apply the different color fibers as yarns or yarn elements onto the needled carrier fleece, the fibers of said yarns which are bound in the compound of the carrier fleece so losely, that they can be needled through the carrier fleece for pattering purposes by the aid of needles. It is not cited in which way and by which means the fibers of the yarn are to be losely bound into the carrier fleece.

SUMMARY OF THE INVENTION

It is the object of the invention to provide an apparatus of the above mentioned kind by which at least one yarn can be tacked at a needled fleece in a predetermined line pattern.

The invention consists of an apparatus of the above mentioned kind, comprising a pressure plate unit having a yarn channel extending essentially in vertical direction through it, means for supplying the yarn along a yarn path from a yarn supply into the yarn channel, at least one needle having laterally protruberant projections, which are suitable for piercing yarn fibers into the needled fleece, a needle holder connected to the pressure plate unit to which the needle is attached, and a drive means for moving up and down the needle holder towards the pressure plate unit, respectively.

Further embodiments of the invention and a combination of the apparatus with a needling machine are subject matter of the subclaims.

The apparatus of the invention, subsequently called as yarn tacker, has to be operated in a way that a yarn from the yarn supply is supplied through the respective yarn guide channel below the pressure plate unit. During operation, the needle pierces through the yarn guide channel into the needled fleece to be patterned which is located below the pressure plate unit and by the up and down movement of the needle fibers from the fibrous yarn are caught by the lateral projections of the needle and are pierced through the needled fleece. During this process, the entire yarn tacker or only the pressure plate unit can be moved together with the needle holder and its drive means laterally to the fibrous fleece in order to establish the desired pattern. By this movement, yarn is automatically drawn from the yarn supply.

The yarn preferrably consists of staple fibers, but yarns made of endless fibers, can also be used, especially crimped endless yarns.

By means of the tacking process which is carried out by the apparatus, only a relatively small amount of the fibers of the yarn is pierced through the fibrous fleece, but this amount is sufficient for tightly attaching the yarn onto the needled fleece so that the yarn cannot be drawn or moved anymore. The piercing depth is not especially critical, it should be deep enough that the yarn fibers entrained by the lateral projections of the needle are pierced into the needled fleece sufficiently to hold the remaining yarn at the needled fleece. This may possibly be carried out up to the other side of the needled fleece or even further, depending on whether it is desired in respect to the appearance of the finished product or not.

In order to catch a sufficient amount of fibers from the yarn by the needle during the down movement, the yarn channel through which the yarn is guided from above below the pressure plate, should have a certain length which is dependent on the thickness and the kind of the yarn used. A good standard value is the length of the yarn channel being at least as large as its diameter, since the latter is determined by the thickness of the yarn used. A length, which is approximately 2 to 3 times as large as the diameter, has proved to be especially suitable.

The needles used in the yarn tacker are velour needles, especially crown needles or fork needles, but felt needles can also be used.

In its simplest embodiment, the invention can be a machine tool in the kind of an electrically driven jig saw, which instead of a saw blade carries a needle with lateral projections and in the pressure plate of which a hole is formed as a yarn guide channel, and which most effectively has a support for receiving a yarn coil and furthermore yarn guiding means, such as eyelets, as usual in sewing machines or stitching machines. By means of such a yarn tacker, yarns of any patterns e.g. individual monograms or strokes can be applied onto a needled fleece, which is located on a support consisting of brushes.

Based on the fact that only a small amount of fibers of the yarn is stuck by the needle from the back through the needled fleece depending on the sticking depth, the pattern first of all does not or almost not appear on the opposite side, i.e. the front side of the fleece. Thus it is necessary to finally pass the needled fleece through a needle loom, in which it is needled from the back side. In a common needle loom, the needle arrangement on a needle bar is very dense, so that most of the fibers of the yarn attached to the back side of the needled fleece are caught by the needle and are stuck through the needled fleece, so that the desired pattern is made clearly visible on the front side of the needled fleece.

For practical purposes of the yarn tacker, it is suitable if it has a cutting device in the area of the yarn guiding channel, possibly very close at the outlet end thereof, by means of said cutting device the yarn is cut, to continue with another pattern at another location of the needled fleece without a yarn being connected to the previously established pattern. In order to avoid that the cut end of the yarn supply slides out of the yarn guiding channel, according to the invention, the cutting device is provided with a clamping device, clamping and holding the yarn end until the next tacking process is started by operating the needle drive.

In order to obtain the simultaneous generation of several patterns parallel to each other, the yarn tacker can comprise a corresponding plurality of needles which are all attached at a needle support which is formed as a needle bar, with a corresponding plurality of yarn channels and, if necessary, cutting devices provided at the pressure plate. Such an embodiment is especially an advantage if the yarn tacker is provided and used as a widely spread installation in combination with a needle loom.

BRIEF DESCRIPTION OF THE FIGURES

The invention will now be described with reference to the drawings.

DETAILED DESCRIPTION OF THE INVENTION

Figure 1:
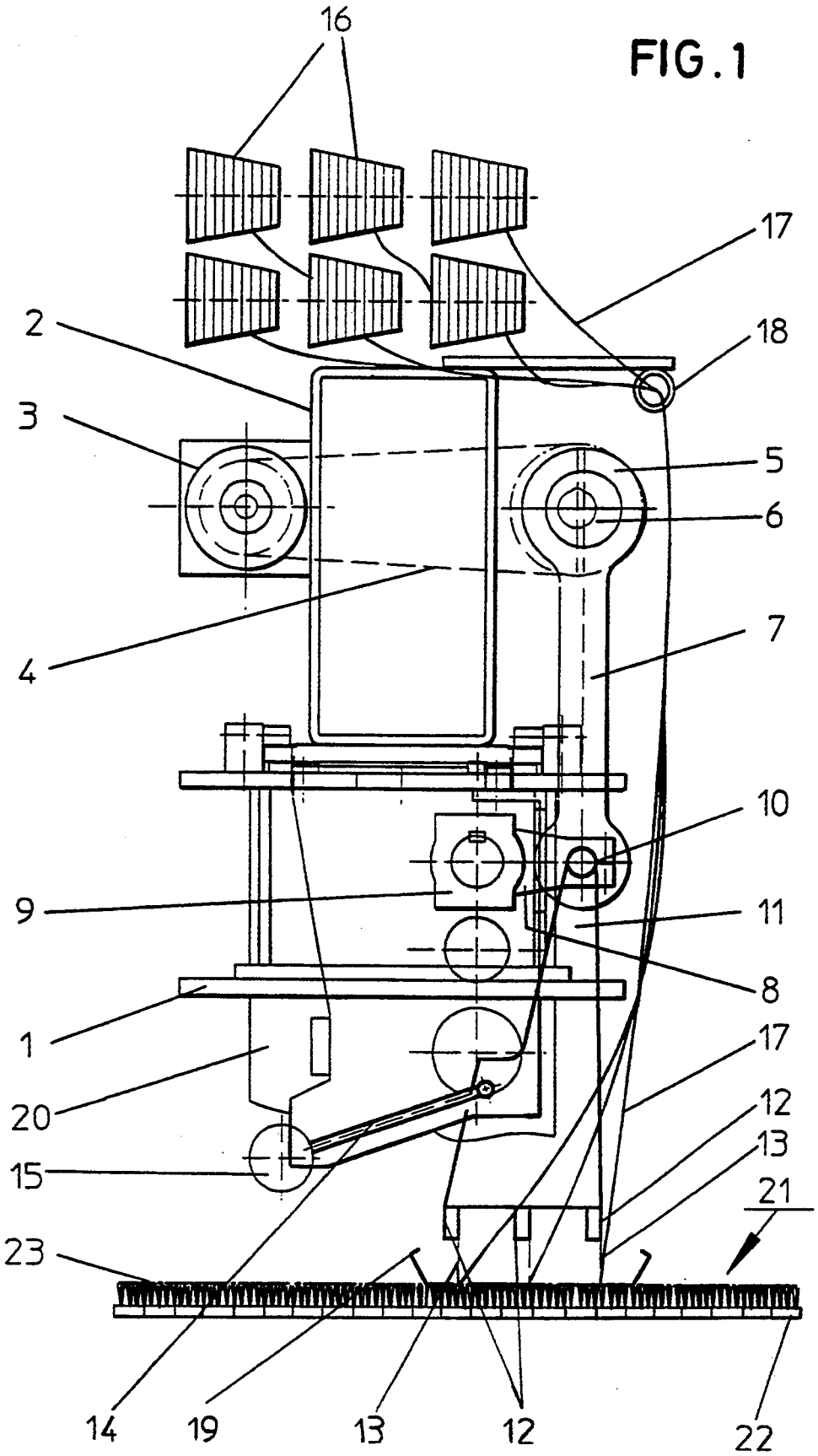
FIG. 1 is a schematic side view of an apparatus according to the invention.

The yarn tacker according to FIG. 1 consists of a console 1, onto which a frame 2 is mounted, which carries a motor 3. The motor 3 can be an electric motor or a hydraulic motor. The motor 3 drives a pulley 5 via a belt 4, which preferrably is a toothed belt, said pulley 5 being rotatably supported at the frame 2 and having an eccentric cam 6. The eccentric cam 6 is surrounded by the upper bearing eye of a connecting rod 7, the lower bearing eye of which is pivotally connected to a swinging lever 8, which is pivotably supported in a bearing block 9 connected to the frame 2. The upper end of a needle bar carrier 11 is mounted at a bearing neck 10, which pivotally connects the lower bearing eye of the connecting rod 7 with the swinging lever 8, with three needle bars 12 being mounted at the lower end of the needle bar carrier 11 in the present case, with several needles 13, e.g. crown needles 80, fork needles 84 or felt needles 82 being attached at the needle bars 12. Furthermore the the needle bar carrier 11 is pivotally connected to the one end of a swinging lever 14, the other end of which is mounted in a bearing 15 mounted to the frame 2. Coil carriers are mounted above the frame 2, on which yarn coils 16 are arranged, with six of them being shown in the present embodiment. Yarns 17 drawn from these coils 16 are extending to a pressure plate 19 via yarn guiding devices 18, said pressure plate being located underneath the needle bars 12 and having holes for the penetration of the needles 13 and the yarns 17. The pressure plate 19 is part of a pressure plate unit 24 and is supported by a support 20 via stays, which are not shown for reasons of simplification. The support 20 is connected to the console 1, or with the frame 2, as is described in a later example.

The shown yarn tacker is adapted to cooperate with a support, characterized by 21, which consists of brush bristles 22, the upper ends of which form a bearing surface for a pre-needled carrier fleece material 23 to be processed, which in the present case is shown by broken lines 23. This kind of support 21 makes it possible to move the yarn tacker laterally in any direction over the support 21, without the needles 13 in operation piercing through the pressure plate 19 colliding with any object.

Figure 2:
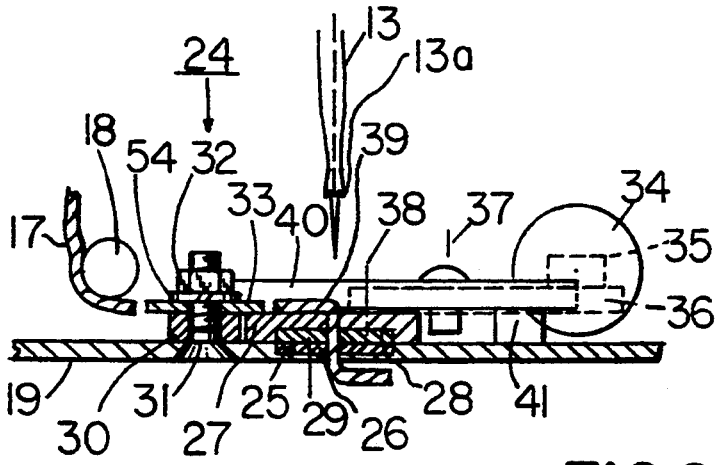
FIG. 2 is a sectional schematic view of a pressure plate unit.
Figure 3:
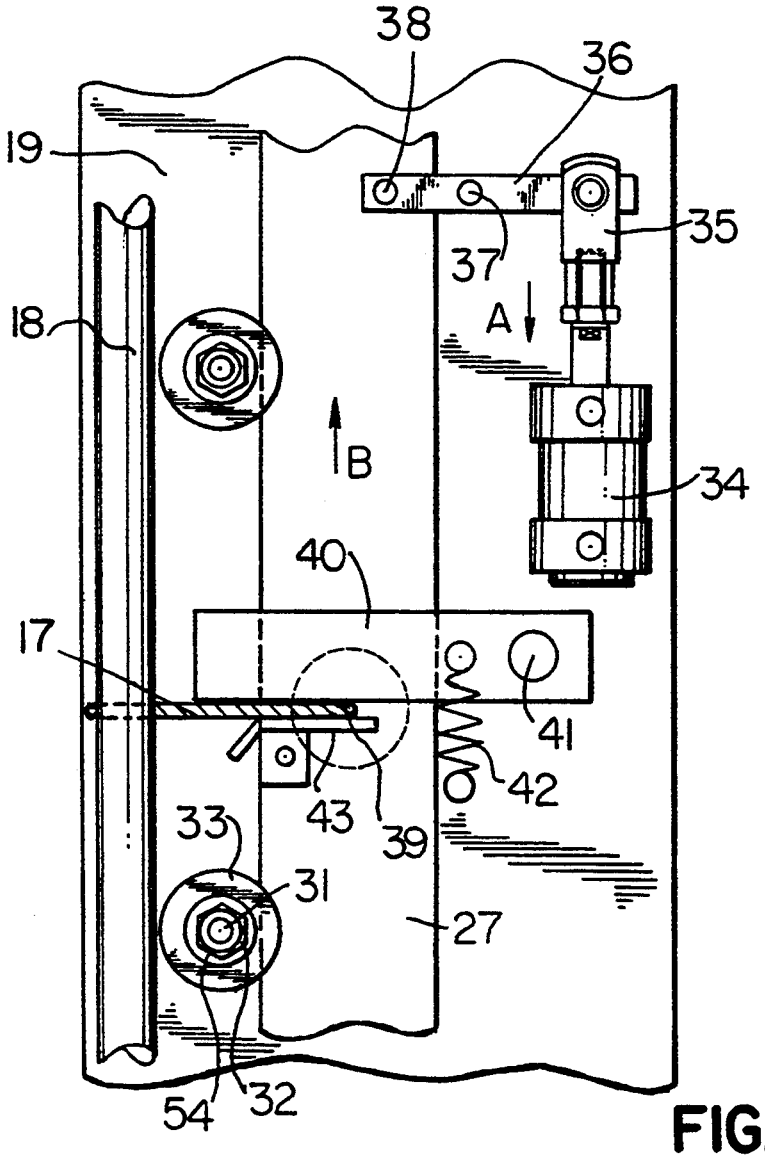
FIG. 3 is a partial view of an arrangement according to FIG. 2, from top.

FIGS. 2 and 3 show a section of the yarn tacker in the area of the pressure plate unit 24 in sectional view and in top view, respectively. The pressure plate unit 24 basically consists of the pressure plate 19 already described, and further elements which will now be described.

A circular recess 25 is formed in the upper side of the pressure plate 19. A cutting disk 26 made of a hard material, preferrably of hard metal is located in the recess, the upper surface of the cutting disk being flushing with the upper surface of the pressure plate or projects a tiny bit therefrom. A cutting plate 27 is arranged on the pressure plate 19, said cutting plate having a circular recess 28 at its lower side, into which a cutting disk 29 is fitted, the lower surface of which is flushing with the lower surface of the cutting plate 27 or projects a tiny bit therefrom. The cutting plate 27 is movably supported on the pressure plate 19 by holding means, e.g. by guide pins 30, which are mounted at the contact pressure plate 19 by means an screws 31, bolts 32 and mounting disks 33. It is of advantage if a certain pressure is applied from above onto the cutting plate in order to keep the cutting disks 26 and 29 in close contact with one another, e.g. by the aid of spring disks 54. In the shown example, see especially the top view of FIG. 3, one of said holding means consisting of the elements 30 to 33 and 54 is shown.

Alternatively, a spring disk can be mounted in the recess 28 of the cutting plate 27 between the cutting plate and the respective cutting disk 29, which is especially suitable in case the cutting plate carries several cutting disks 29, so that they can adjust themselves individually.

The cutting plate 27 is movable parallel to the pressure plate 19 by means of an operating mechanism, which has a cutting drive 34, e.g. a solenoid or a pneumatic cylinder or hydraulic cylinder, having a tie rod 35 and a rocking lever 36 which is pivotally supported at the pressure plate 19 at the pin 37 and the ends of which are connected to the tie rod 35 and to the cutting plate 27, respectively. At the connection 38 with the cutting plate 27, the rocking lever 36 can, if necessary, have an oblong hole, which is longitudinal in the direction of the longitudinal extension of the rocking arm 36.

Holes are disposed in the cutting plate 27 in the cutting disc 29 located therein in the cutting disc 26 situated in the pressure plate 19 and finally in the pressure plate 19, said holes together forming a continuous yarn channel 39 through which the yarn 17 extends from the yarn guide 18 from above to the lower side of the pressure plate 19. A needle 13 is located in axial alignment with this yarn channel 39 above the pressure plate unit 24, said needle being provided with lateral projections 13*a* which are suitable at penetrating the needle 13 into the yarn channel 39 to take up fibers from the yarn 17 in the yarn channel 39. In the working condition shown in FIGS. 2 and 3, the cutting plate is located in a position in which the holes formed in it and in the cutting disk 29 supported by it, are in alignment with the hole in the pressure plate 19 and the cutting disk 26 supported thereby.

A yarn clamping tag 40 is pivotably mounted by a pin at the pressure plate 19 and is influenced by a resetting spring 42 supported at the contact pressure plate 19 and urging the yarn clamping tag 40 in the rest position shown in FIG. 3. The yarn clamping tag 40 extends in lateral direction to the yarn path, which extends from the yarn guiding means 18 to the yarn channel 39. Another yarn clamping tag 43 is located opposite to the yarn clamping tag 40, and is mounted on the cutting plate 27. The two yarn clamping tags 40 and 43 define a section of the yarn path between each other, which ends at the yarn channel 39.

Alternatively, at least one of the yarn clamping tags 40, 43 may consist of a resilient material, so that a resiliently movable support of the yarn clamping tag 40 as shown in the drawings may be avoided.

The holes in the two cutting disks 26 and 29 have sharp edges at the surfaces facing each other, so that they are able to cut the yarn 17 running through the yarn channel 39, if the two disks 26, 29 are moved laterally to each other. The sharp edges of the cutting disks 26 and 29 work like scissors. The diameter of the holes in the cutting disks 26, 29 is preferably a bit larger than the diameter of the holes in the cutting plate 27 and the pressure plate 19, so that in case the cutting disks 26, 29 are not reset to an exact alignment by the cutting drive 34, the yarn 17 does not rub at their cutting edges and is damaged thereby.

In the tacking operation of the described yarn tacker, the cutting plate 27 has the position shown in FIG. 3, in which the holes in the cutting disks 26 and 29 are coaxial. The needle 13 mounted at the needle support 12 (FIG. 1) is put in up and down movement by the motor 3 via the eccentric cam 6, the connecting rod 7 and the needle bar carrier 11, and it penetrates into the yarn channel 39 and into the needled fleece 23 located underneath the pressure plate 19 on the support 21. It catches fibers of the section of the yarn 17, in the yarn channel 39 and needles these fibers into the needled fleece 23. If the entire yarn tacker is laterally moved during operation, i.e. slidingly across the needled fleece 23, yarn 17 is drawn from the respective coil 16 and is continuously tacked by the needle 13 onto the needled fleece 23 by means of the fibers drawn out of the yarn 17 by the lateral projections of the needle 13.

When a pattern formed in this way by the yarn 17 on the needled fleece 23 is finished and the yarn 17 is to be cut in order to begin with a new pattern at another location, the motor 3 is stopped in a position, in which the needle 13 is brought in the uppermost position, as is shown in FIG. 2. As long as this is not the case, the cutting drive 34 is blocked by a safety device, preferrably electronically controlled, which is not shown in the drawing. In this raised position of the needle 13, the cutting drive 34 is excited which draws the tie rod 35 in the direction of the arrow A, by means of which via the rocking lever 36 the cutting plate 27 is displaced in the direction of the arrow B. By this, the holes in the cutting disks 26 and 29 are brought out of alignment, so that its cutting edges cut the yarn 17. Simultaneously, the yarn clamping tag 43 attached at the cutting plate 43 approaches the opposite resiliently supported yarn clamping tag 40, by which the yarn end, extending into the yarn channel 39, is held between the yarn clamping tags 40, 43 in clamped fashion. If finally the cutting drive 34 is de-energized, so that the cutting plate 27 returns into its rest position, the needle 13 finds a yarn end in the yarn channel 39, from which it can pierce fibers into the needled fleece 23 upon restarting the operation of the motor 3. Preferrably the operation of the cutting drive 34 is controlled in a way in that only immediately before restarting the motor 3 the cutting drive 34 is de-energized, so that in the meantime, the yarn 17 is not released from clamping between the yarn clamping tags 40, 43.

The yarn tacker according to FIGS. 1 to 3 can, as already described, be formed and driven by an electrically driven, manually guided hand tool, e.g. a jig saw like tool. In the scale of the invention, however, it is also possible to combine the yarn tacker according to FIG. 1 with a cross slide onto which it is mounted and which moves it, controlled by a corresponding programm comprising the pattern to be generated, across a needled fleece located on a non-moving support. Details of such a cross slide are not described, since apparatuses of this kind are generally known in technology. If a continuous needled fleece is processed by the yarn tacker, said fleece can be passed through continuously or discontinuously underneath the yarn tacker located on the cross slide and can then be rolled up for temporary storage or can be directly supplied to a needle loom disposed downstream. A solution of the latter kind is shown in FIG. 4.

As mentioned above, only a small amount of the fibers of the yarn, which is to generate a predetermined pattern on the needled fleece, is needled through the needled fleece by the yarn tacker. For increasing the visibility of the pattern it is necessary to needle larger amounts of the fibers forming the yarn through the needled fleece. This working step is usually carried out by a needle loom of a known construction, which contains at least one needle beam, which carries a plurality of needles parallely arranged in small distances to each other, so that is is quite likely, that the yarn is hit by these needles and a large amount of fibers are caught and are needled through the fibrous fleece. In view of this necessity, FIG. 4 shows an advantageous combination of a yarn tacker of the invention and a needle loom.

Figure 4:
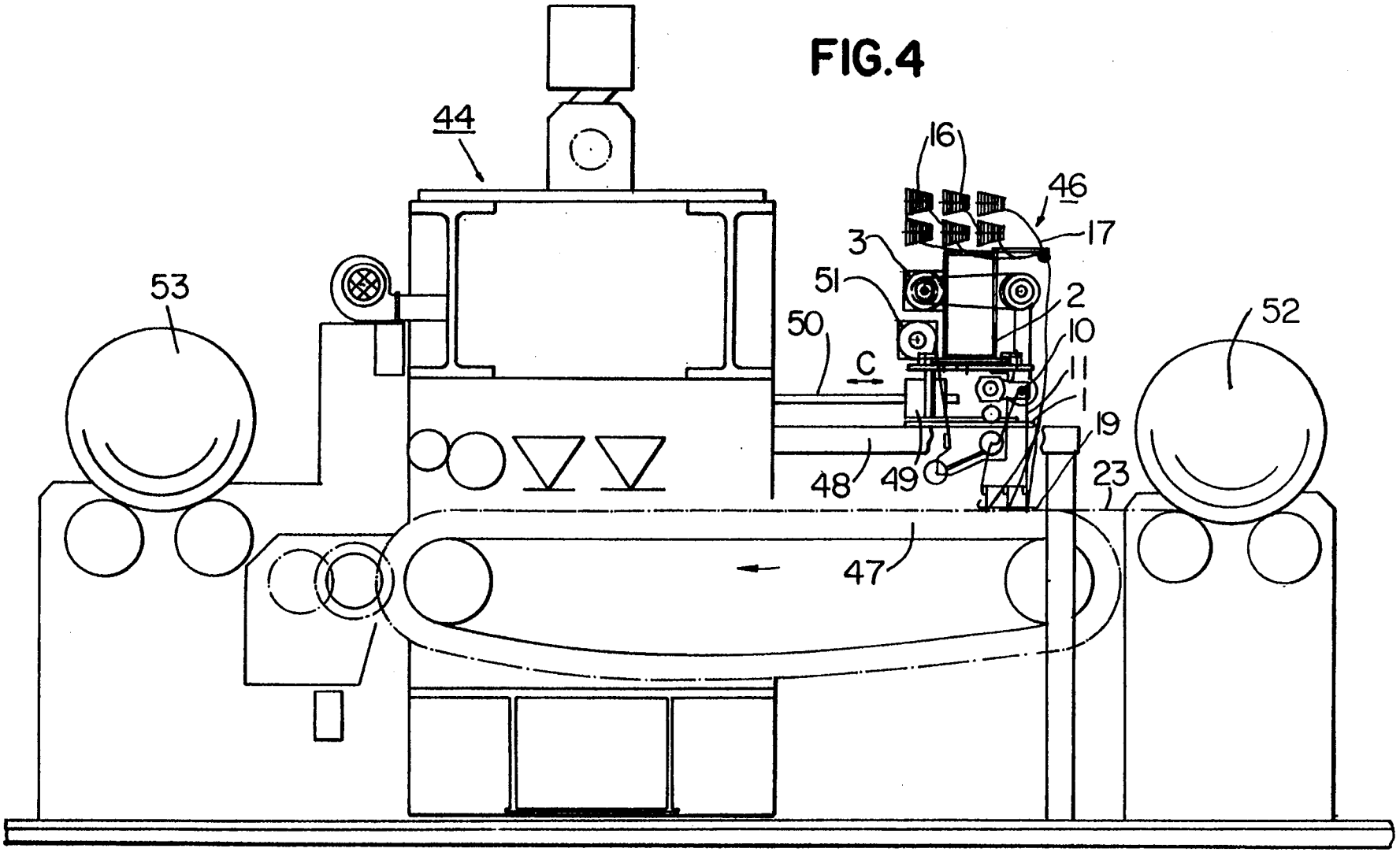
FIG. 4 is a schematic view of the combination of an apparatus of the present invention and provided with a plurality of needles and a needle loom.

According to FIG. 4, the yarn tacker which is characterized by 46 is arranged at the inlet of a needle loom characterized by 44, with two needle beams thereof being schematically shown by 45. The pressure plate 19 of the yarn tacker 46 is located above the support, which consists of an endless brush band 47 in this example, which extends through the needle loom 44 and the bristle tips of which are shown by a dash-dotted line in FIG. 4. The console 1 of the yarn tacker 46 is movable on a horizontal carrier guide rail 48 in direction of the arrow C towards and away from the needle loom 44. The movement is effected by a drive which can be hydraulical, neumatical or electrical. In the shown example, the drive is shown as a spindle motor 49, which is mounted on the console 1 and the spindle 50 of which is mounted at the needle loom 44. The frame 2 is horizontally movably mounted on the console 1, its moving direction extending transversely to the moving direction shown by the arrow C, and a drive means 51 is arranged at the frame 2 by means of which this transverse movement of the frame 2 with respect to the console can be caused. That is, it is the combination of the console 1 and frame 2 that constitutes the cross slide which is able to move the yarn tacker in a two-dimensional pattern. All the aggregates which are necessary to tack yarns 17 onto the needled fleece 23 are connected to the frame 2, i.e. the pressure plate 19 with the respective yarn channels, the needle bar carrier 11 with the respective drive means from motor 3 to the journal 10. Upon excitation of the drives 49 and 51 the yarn tacker 46 generating the patterns, can be moved across the needled fleece in two directions which are orthogonal to each other.

The needled fleece 23 is supplied by a supply roll 52 in the shown example, runs on the brush band 47 underneath the yarn tacker 46 and through the needle loom 44 and is wound to form a roll 53 at the outlet of the needle loom 44. It is understood, that the brush band 47 is supported from below in the working areas of the yarn tacker 46 and the needle loom 44, e.g. by means of rolls or plates, which are not shown for reasons of simplification.

Furthermore it is to be understood, that the yarn tacker 46 in FIG. 4 preferrably is equipped with the yarn cutting devices shown in FIG. 2 and 3. The yarn tacker 46 can extend almost over the entire width of the needle loom 44 and can have a corresponding plurality of needles 13 with respective yarn coils 16, in order to be able to simultaneously produce several patterns parallel in one working cycle on the needled fleece 23.

For the operation of the combination shown in FIG. 4, it can be provided, that the needled fleece can be guided intermittingly or continuously through the arrangement or its feed direction can, if necessary, temporarily be inversed if this is necessary for the generation of a certain pattern. The material rolls 52 and 53 are to be correspondingly moved in this case on their devices carrying them, if necessary their drive directions are to be changed. The operation in the needle loom 44 and the yarn tacker 46 is carried out by the control of predeterminded programs, with the operation of the needle loom 44 and the yarn tacker 46 being suitably adapted to one another. The timing of the working steps also comprises the yarn cutting device contained in the yarn tacking device 46, if necessary, by which it is guaranteed by the mentioned safety device, that the cutting drive 34 for the cutting plate 27 is only activated, if the needles 13 have come to a standstill in a raised position.

Finally, it is to be mentioned that the needled fleece to be patterned may be a pre-needled fiber fleece, a felt material or even a velours material, the density of which allows the fleece to be exposed to another needling process by which the fibers of the yarn tacked onto said fleece are needled through said fleece.

I claim:

1. Apparatus for tacking a yarn onto a needled fleece in a predetermined line pattern having means for supporting said needled fleece, said apparatus comprising:

a frame, a pressure plate unit engaging said needled fleece, said frame being movable in a plane parallel to said supporting means, said pressure plate unit comprising a yarn channel extending substantially vertically therethrough;

means attached to said frame for supplying said yarn into said yarn channel;

a needle support vertically movably mounted to said frame;

a needle mounted in said needle support and having a plurality of projections for piercing fibers of said yarn into said needled fleece; and means for driving said needle support and needle in a generally vertical direction from a first raised position towards said pressure plate unit to a second lowered position when said needle is inserted in said yarn channel extending through said pressure plate unit and into said needled fleece.

2. The apparatus according to claim 1 wherein said supporting means comprises brushes having bristles with free ends that support said needled fleece.

3. The apparatus according to claim 2 wherein said projections of said needle are lateral.

4. The invention according to claim 3 wherein said yarn channel has a length which is at least equal to the diameter of said channel.

5. The apparatus according to claim 4 wherein said needle support is a needle bar.

6. The apparatus according to claim 1 further comprising a frame to which said pressure plate unit is mounted and to which said needle support is movably mounted and separate drive means for driving said frame in a direction parallel to said support.

7. Apparatus for tacking a yarn onto a needled fleece in a predetermined line pattern having means for supporting said needled fleece, said apparatus comprising:

a frame, a pressure plate unit engaging said needled fleece, said frame being movable in a plane parallel to said supporting means, said pressure plate unit comprising a yarn channel extending substantially vertically therethrough;

means attached to said frame for supplying said yarn into said yarn channel;

a needle support vertically movably mounted to said frame;

a needle mounted in said needle support and having a plurality of projections for piercing fibers of said yarn into said needled fleece; and means for driving said needle support and needle in a generally vertical direction from a first raised position towards said pressure plate unit to a second lowered position when said needle is inserted in said yarn channel extending through said pressure plate unit and into said needled fleece;

wherein said pressure plate unit further comprises:

a movable cutting plate having a first opening that defines a hole having upper and lower edges for passing yarn therethrough, the lower edge of said first opening being sufficiently sharp to cut said yarn;

a pressure plate engaging said needled fleece and having a second opening that defines a hole having upper and lower edges, said second opening being axially aligned with said first opening, said second opening having an upper edge sufficiently sharp to cut said yarn and located adjacent to said lower sharp edge of said first opening;

second drive means attached to said cutting plate and said pressure plate for moving said cutting plate laterally with respect to said pressure plate and causing said first and second holes to mis-align, said first and second openings defining said yarn channel;

a first yarn clamping tag mounted on said cutting plate and a second yarn clamping tag mounted on said pressure plate, said first and second clamping tags arranged laterally to a portion of said yarn between said tags in a yarn path extending from said yarn supply to said yarn channel, said first and second yarn clamping tags being adjacent each other when said openings are brought out of alignment by moving the cutting plate.

8. The apparatus according to claim 7 wherein one of said first and second clamping tags is resilient.

9. The apparatus according to 7 wherein said pressure plate has a recess and said cutting plate has a recess and said apparatus further comprises first and second cutting disks which fit within said recesses respectively, said first and second cutting disks having said first and second openings disposed therein, respectively.

10. The apparatus according to claim 8 wherein said pressure plate has a recess and said cutting plate has a recess and said apparatus further comprises first and second cutting disks which fit within said recesses respectively, said first and second cutting disks having said first and second openings disposed therein, respectively.

11. The apparatus according to claim 9 wherein said opening in each said cutting disk has a diameter larger than the diameter of each said opening in said pressure plate and said cutting plate.

12. The apparatus according to claim 7 further comprising a safety device for locking said cutting plate when said needle is in its second lowered position.

13. The apparatus according to claim 8 further comprising a safety device for locking said cutting plate when said needle is in its second lowered position.

14. The apparatus according to claim 9 further comprising a safety device for locking said cutting plate when said needle is in its second lowered position.

15. The apparatus according to claim 11 further comprising a safety device for locking said cutting plate when said needle is in its second lowered position.

16. Apparatus for tacking a yarn onto a needled fleece in a predetermined line pattern having means for supporting said needled fleece, said apparatus comprising:

a frame, a pressure plate unit engaging said needled fleece, said frame being movable in a plane parallel to said supporting means, said pressure plate unit comprising a yarn channel extending substantially vertically therethrough;

means attached to said frame for supplying said yarn into said yarn channel;

a needle support vertically movably mounted to said frame; and a needle mounted in said needle support and having a plurality of projections for piercing fibers of said yarn into said needled fleece; and means for driving said needle support and needle in a generally vertical direction from a first raised position towards said pressure plate unit to a second lowered position when said needle is inserted in said yarn channel extending through said pressure plate unit and into said needled fleece;

wherein said supporting means comprises brushes have bristles with free ends that support said needled fleece;

wherein said projections of said needle are lateral;

wherein said yarn channel has a length which is at least equal to the diameter of said channel; and wherein said needle support is a needle bar further comprising a plurality of needles mounted to said needle support and said pressure plate further comprises a corresponding plurality of yarn channels for said plurality of needles.

17. The apparatus according to claim 16 wherein said needle support is a needle bar.

18. The apparatus according to claim 17 further comprising a plurality of first yarn clamping tags and second yarn clamping tags for said plurality of yarn channels, one of said plurality of first clamping tags and second clamping tags being resilient.

19. The apparatus according to claim 17 wherein said cutting plate and pressure plate have a plurality of cutting disks and yarn clamping tags disposed therein corresponding to said plurality of needles.

20. Apparatus for tacking a yarn onto a needled fleece in a predetermined line pattern having means for supporting said needled fleece, said apparatus comprising:

a frame, a pressure plate unit engaging said needled fleece, said frame being movable in a plane parallel to said supporting means, said pressure plate unit comprising a yarn channel extending substantially vertically therethrough;

means attached to said frame for supplying said yarn into said yarn channel;

a needle support vertically movably mounted to said frame;

a needle mounted in said needle support and having a plurality of projections for piercing fibers of said yarn into said needled fleece; and means for driving said needle support and needle in a generally vertical direction from a first raised position towards said pressure plate unit to a second lowered position when said needle is inserted in said yarn channel extending through said pressure plate unit and into said needled fleece;

wherein said needle is a velour needle further comprises a cross slide having a frame and movable along two axes orthogonal to each other and drive means for driving said frame along said axes.

21. Apparatus for tacking a yarn onto a needled fleece in a predetermined line pattern having means for supporting said needled fleece, said apparatus comprising:

a frame, a pressure plate unit engaging said needled fleece, said frame being movable in a plane parallel to said supporting means, said pressure plate unit comprising a yarn channel extending substantially vertically therethrough;

means attached to said frame for supplying said yarn into said yarn channel;

a needle support vertically movably mounted to said frame;

a needle mounted in said needle support and having a plurality of projections for piercing fibers of said yarn into said needled fleece; and means for driving said needle support and needle in a generally vertical direction from a first raised position towards said pressure plate unit to a second lowered position when said needle is inserted in said yarn channel extending through said pressure plate unit and into said needled fleece;

further comprising drive means for driving said frame in a direction parallel to said support this apparatus in combination with a needle loom having an inlet at which said apparatus is disposed for needling the yarn tacked to the needled fleece supplied to the needle loom as a continuous fleece, with the bristles being part of an endless brush band which extends through the needle loom and which serves as a support for the needled fleece in the needle loom.

22. The apparatus according to claim 20 in combination with a needle loom having an inlet at which said apparatus is disposed for needling the yarn tacked to the needled fleece supplied to the needle loom as a continuous fleece, with the bristles being part of an endless brush band which extends through the needle loom and which serves as a support for the needled fleece in the needle loom.

23. The apparatus according to claim 22 further comprising a control device for controlling the operation of the needle loom, the drive of the brush band, the drive means for the needle support, the drive means for laterally moving the cutting plate as well as the drive means for said frame.

24. The apparatus according to claim 23 wherein one of said first and second clamping tags is resiliently supported.

25. The apparatus according to claim 26 wherein one of said first and second clamping tags is resilient.

26. The apparatus according to claim 25 further comprising a plurality of first yarn clamping tags and second yarn clamping tags for said plurality of yarn channels, the tags of one of said plurality of first clamping tags and second clamping tags being resiliently supported.

27. The apparatus according to claim 26 further comprising a plurality of first yarn clamping tags and second yarn clamping tags for said plurality of yarn channels, the tags of one of said plurality of first clamping tags and second clamping tags being resilient.

28. The apparatus according to claim 27 where the tags of one of said first and second clamping tags are resiliently supported.

29. The apparatus according to claim 28 wherein the tags of one of said first and second clamping tags is resilient.

* * * * *

UNITED STATES PATENT AND TRADEMARK OFFICE

CERTIFICATE OF CORRECTION

PATENT NO. : 5,390,399

DATED : February 21, 1995

INVENTOR(S) : Johann P. Dilo

It is certified that error appears in the above-indentified patent and that said Letters Patent is hereby corrected as shown below:

Cover Page, [73] Assignee:, change "AK" to —KG—.

Signed and Sealed this

Ninth Day of May, 1995

*Attest:*

*Attesting Officer*

BRUCE LEHMAN

*Commissioner of Patents and Trademarks*